US006148551A

United States Patent [19]

Glass

[11] Patent Number: 6,148,551

[45] Date of Patent: Nov. 21, 2000

[54] TRANSPORTABLE SYSTEM FOR MESSAGE DISPLAY

[76] Inventor: Hilton J. Glass, 2118 Lauren Dr., Biloxi, Miss. 39532

[21] Appl. No.: 09/336,598

[22] Filed: Jun. 22, 1999

Related U.S. Application Data

[63] Continuation-in-part of application No. 08/914,330, Aug. 19, 1997, abandoned.

[51] Int. Cl.[7] ..... G09F 21/06

[52] U.S. Cl. ..... 40/214; 40/610

[58] Field of Search ..... 40/214, 610

[56] References Cited

U.S. PATENT DOCUMENTS

| | | | |
|---|---|---|---|
| 460,674 | 10/1891 | Gross | 40/214 |
| 1,776,182 | 9/1930 | Cook | 40/214 X |
| 1,912,960 | 6/1933 | Aki et al. . | |
| 3,346,978 | 10/1967 | Letsinger . | |
| 3,484,974 | 12/1969 | Culmone . | |
| 3,670,440 | 6/1972 | Yost | 40/215 |
| 4,369,591 | 1/1983 | Vicino | 40/610 |
| 4,421,204 | 12/1983 | Lawrence . | |
| 4,597,633 | 7/1986 | Fussell | 40/212 X |
| 4,776,121 | 10/1988 | Vicino | 40/610 |
| 4,787,575 | 11/1988 | Stewart | 40/214 X |
| 4,920,674 | 5/1990 | Shaeffer | 40/214 X |
| 5,125,177 | 6/1992 | Colting | 40/610 |
| 5,152,092 | 10/1992 | O'Brien | 40/610 |
| 5,293,707 | 3/1994 | Shaeffer | 40/214 X |
| 5,322,219 | 6/1994 | Esplin . | |
| 5,402,591 | 4/1995 | Lee | 40/610 |
| 5,542,203 | 8/1996 | Luoma et al. | 40/610 |

FOREIGN PATENT DOCUMENTS

| | | | |
|---|---|---|---|
| 169485 | 7/1989 | Japan | 40/214 |

*Primary Examiner*—Joanne Silbermann
*Attorney, Agent, or Firm*—Joseph T. Regard, Ltd plc

[57] ABSTRACT

A system for displaying a message, which includes a base portion, which is mounted on wheels and securable to a movable vehicle such as an automobile; an inflatable balloon mounted to a supporting circular base member configured to engage the constricted portion of the balloon, the circular base member further having a diameter and a height emanating from the base portion; a blower positioned within the base portion for blowing air through the circular base member and into the lower opening of the balloon and inflating the balloon to a point above the circular base member; a light mounted on the base portion, and within the circular base member within the opening in the lower end of the balloon for providing light into the interior of the inflated balloon and the light, in turn, lighting the exterior of the balloon; Velcro strips positioned on an outer surface of the inflated balloon, so that a message display banner may be mounted to the Velcro strips for displaying messages on the inflated lighted balloon, as the balloon is moving or is stationary; and a zippered portion of the balloon body, so that when the blower is turned off, the balloon is deflated, and the balloon is able to be stored within an area between walls of the base portion and the light, so that a cap member may be placed over the light and the entire system may be transported in the deflated state.

18 Claims, 7 Drawing Sheets

TRANSPORTABLE SYSTEM FOR MESSAGE DISPLAY

STATEMENT OF CONTINUING APPLICATIONS

The present application is a Continuation-in-part of U.S. patent application Ser. No. 08/914,330, filed Aug. 19, 1997, now abandoned listing as inventor Hilton Glass and entitled "Transportable System for Message Display".

BACKGROUND OF THE INVENTION

1. Field of the Invention

The system of the present invention relates to message displays, and more particularly a transportable message display system which has the capability of displaying a message on an inflated, illuminated and colorful balloon while the system is being transported via a vehicle or which may be positioned stationary as an attraction and advertising medium. The system is therefore designed to provide a structurally stable platform and support system for an inflatable balloon or like media, including a compact tether system, as well as a raised collar emanating from the top of the platform, the collar providing a circular support having a periphery configured to engage the periphery of the balloon at its base.

The raised collar or circular support member is configured to reside within the balloon so that it is not noticed from the exterior of the unit, yet it is configured to provide important structural support for the balloon so as to prevent swaying or bending of the balloon during winds or when the unit is deployed in mobile fashion, such as during a parade or other mobile event.

2. General Background of the Invention

In the art of advertising and other types of message displays, it is quite commonly found that messages are often provided on various types of media, including vehicles, billboards, and most recently, for example, on the exterior side of inflatable balloons such as the GOODYEAR and FUJI brand blimps. Furthermore, advertising displays are also found on other types of inflatables, such as balloons which are positioned atop buildings or other structures, in order to offer a colorful and eye-catching advertising medium for potential customers.

Although the displays as mentioned above, such as the blimp displays, are capable of moving over a vast area of territory, most, if not all of the inflatable displays which are land bound, are incapable of being transported in their display form, and in most cases are anchored to a structure, for example, a parking lot base, and therefore become immovable. The problem which is encountered, is the ability to enable an inflatable display to maintain itself in the inflated state while it is being transported, and to assure that the transport of the inflatable is accomplished, so that when the inflatable is deflated, that it can be transported in the deflated state without having to undergo any serious modifications or the like which would be very difficult and quite expensive to accomplish. Further, the design of portable inflatable displays hinders their use in high winds or in a transported fashion, as these types of displays generally are rather cumbersome, and prone to swaying, bending, and or collapsing when exposed to winds, either stationary or if one were to attempt to deploy such a display, for example, on a trailer in motion.

Therefore, what is needed in the art for message or advertising displays on inflatables is the ability to have the inflatable inflated so that it can be transported in the inflated state, and used as an advertising or message medium, yet it can be reverted to the deflated state, and stored within the transport vehicle so that it can be easily transported and re-inflated at a second point, while at the same time providing a compact, yet structurally sound and effective support system for the inflated medium. There are several patents which have been found in the art which may be pertinent to this invention, and these are listed in the accompanying prior art statement filed herewith.

BRIEF SUMMARY OF THE INVENTION

The apparatus of the present invention solves the shortcomings in the art in a simple and straightforward manner. What is provided is a system for displaying a message, which includes a base portion, which is mounted on wheels and securable to a movable vehicle such as an automobile; a circular base member having a height and a diameter emanating from the base portion, defining a lower open portion, an inflatable balloon mounted on its lower end about the diameter of the circular base member; a blower positioned in the base portion for blowing air through the circular base member, and into the lower opening of the balloon and inflating most of the balloon to a point above the circular base member; a light mounted on the base portion within the circular base member, directed into the balloon for providing light into the interior of the inflated balloon and in turn, lighting the exterior wall of the balloon; Velcro strips positioned on an outer surface of the inflated balloon, so that a message display banner may be mounted to the Velcro strips for displaying messages oil the inflated lighted balloon, as the balloon is moving or is stationary; and a zippered portion of the balloon body, so that when the blower and light are turned off, the balloon is deflated, and the balloon is able to be stored within the circular base member and the light, so that a cap member may be placed over the circular base member, covering the deflated balloon and the light, so that the entire system may be transported in a compact, deflated state; and an electrical source which would include a self-powered generator for supplying power to both the light and the blower while the inflated balloon is being transported so that the message may be displayed during transport.

Therefore, it is the principal object of the present invention to provide a system for attracting attention and providing a message on an inflatable medium, which allows the inflated medium to be transported while the message is being displayed.

It is a further object of the present invention to provide an advertising medium of an inflated balloon having a lighted surface so that a message may be placed on the lighted surface and displayed while the inflated balloon is being transported.

It is a further object of the present invention to provide a self-contained message display system, which can be transported while the system is in the storage configuration, and can be transported when the system is in the message display configuration, without having to maintain the system stationary.

It is a further object of the present invention to provide a message display system which allows a message to be displayed on a lighted and inflated balloon mounted on a wheeled base, with the wheel base serving as a means for transporting the system over land.

Lastly, it is an object of the present invention to provide a message display system wherein there is provided a circular base member emanating from the base portion, the circular base member having a diameter substantially equivalent to the diameter of the lower portion of the inflatable medium or balloon, the circular base member also having a height configured to stabilize the lower, generally narrow or constricted portion of the balloon.

BRIEF DESCRIPTION OF THE DRAWINGS

For a further understanding of the nature, objects and advantages of the present invention, reference should be had to the following detailed description, read in conjunction with the following drawings, wherein like reference numerals denote like elements and wherein.

DETAILED DESCRIPTION OF THE INVENTION

Figure 1:
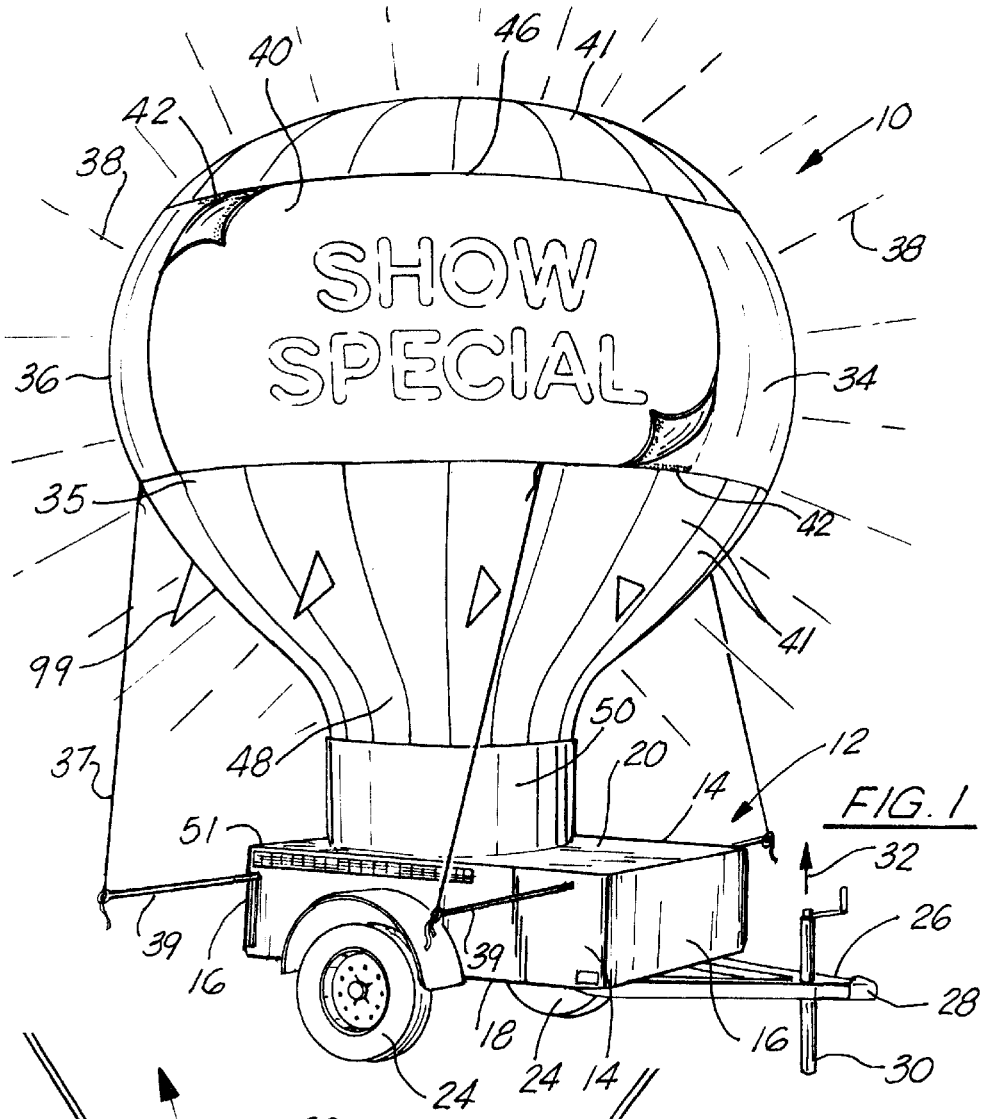
FIG. 1 illustrates an overall view of the preferred embodiment of the system of the present invention.

Referring to the overall view of the system as illustrated in FIG. 1, system 10 would comprise a base portion 12 having a pair of side walls 14, and a pair of end walls 16, a floor portion 18, and a top portion 20, for defining an interior space 22 therein.

The base portion 12, as illustrated in FIG. 1, is mounted upon a pair of wheels 24, so that the base portion may be transported by a vehicle via a utility trailer mount 26 having a coupling 28. There is further provided a hand crank tongue jack 30 for maintaining the base portion 12 in the stationary upright position as seen in FIG. 1. Of course, when the system is transported, the jack 30 would be moved to the up position in the direction of arrow 32 and the coupling 28 would be secured to the rear of a vehicle such as a truck or the like for transporting.

Further, as illustrated, base portion 12 would include an inflated balloon 34 extending upright above the base portion 12 as illustrated. The balloon would be of the type having a balloon envelope which would be a UV resistant 200 denier fabric utilizing a polyurethane cording. Balloon 34 is maintained in the inflated state via a blower as will be shown in the other views, so that the continuous wall portion 36 of balloon 34 is maintained in the inflated state, as illustrated in FIG. 1.

Further, there is included a plurality of support lines 37 which extend from the side wall of the inflated balloon to support arms 39 or outriggers extending outward from the base portion 12 as illustrated in FIG. 1. These support lines 37 would help to maintain the balloon stable either while the balloon is being moved or during strong winds or the like. Further, lines 38 represent light which is emanating through the wall 36 of the balloon 34, again, the source of light as will be discussed further in other figures.

Continuing to discuss FIG. 1, the wall 36 of balloon 34 includes a message display portion 40, which includes, for example, a message 41 "SHOW SPECIAL", which is spanned across the wall 36 of balloon 34 for displaying the message on the lighted wall 36 of the balloon. As illustrated, the message in the preferred embodiment would be secured to the wall 36 of balloon 34 via a loop and hook attachment 42 commonly known under the VELCRO brand, with one portion of attachment 42 being secured to the wall 36, and the second portion of the loop and hook attachment 42 secured to the message 40, so that the message would be secured thereupon throughout its entire border 46 as seen in FIG. 1.

In the preferred embodiment, the messages may be six feet wide and approximately four feet high utilizing nylon message banners with VELCRO and plastic letters/numbers with VELCRO. The signage portion of the wall 36 of balloon 34 would be around the equator 35 of the balloon or the central portion, which would be in the preferred embodiment approximately four feet in length and would have a 360 degree surface area. As stated earlier, there would be a VELCRO strip or the like around each upper and lower end of the four foot equator for providing the signs to be placed thereupon.

As further illustrated in FIG. 1, the lower, constricted end 48 of the balloon 34 is envelopes, engages, and substantially supported by a circular base member 50 having a diameter and a height, from which the balloon extends upright as air is forced into the balloon via the blower, as well as providing support for the balloon in high wind or mobile use, again as will be discussed further. Further, it is illustrated in FIG. 1 the side walls 14 of base 12 include air entry vents 51 which would allow air to be moved into the interior 22 of base 12 when the blower is activated so that the air may then be blown into the interior of the balloon 34.

Figure 2:
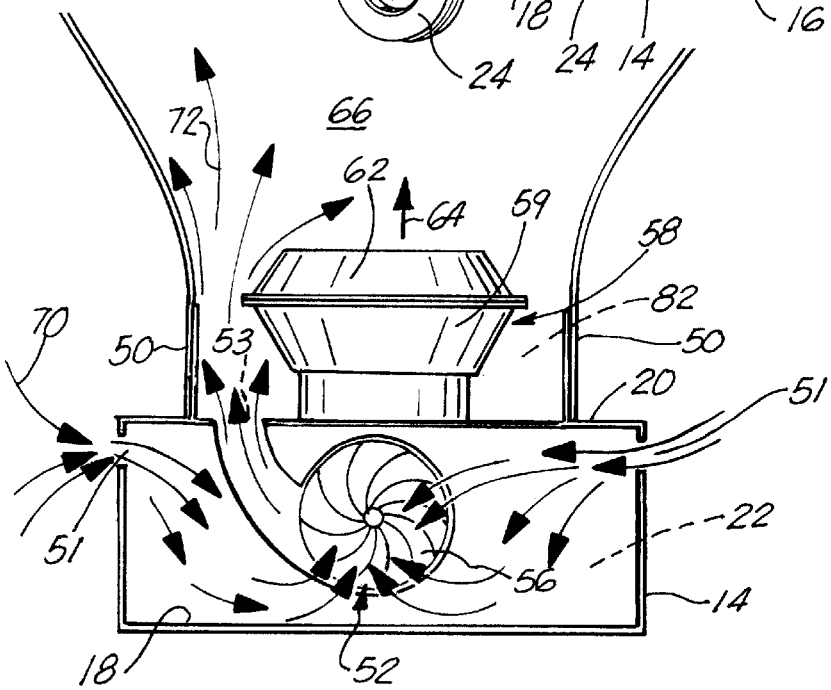
FIG. 2 illustrates a partial cross-sectional view of the base portion housing the light and blower in the preferred embodiment of the present invention.

As illustrated in FIG. 2 in cross-sectional view, there is illustrated the base 12 with the side walls 14 and with a cross section view of the base 12 through end wall 16. As illustrated, there is positioned a blower 52 mounted on the lower face of floor portion 18 of base 12, and is suspended therefrom for injecting air directly through air flow port 53 into the circular base member 50 and into balloon 34 to inflate the balloon 34 as seen in FIG. 1. The blower 52 would be of the type manufactured which is known as a continuous regulated air blower, which is known as a "squirrel cage type blower system" which would include, of course, a motor portion and a circular blade portion 56 with the blower activated through electrical power, and including a blower switch mounted on the base. The blower 52 may also be used to cool the lighting system as will be discussed further.

As illustrated, the blower 52 mounted on the lower face of floor 18 and suspended therefrom is suspended at a point directly below the lighting system 58 and as air would blow through blower 52, would tend to cool the lighting system 58. As is noted, FIG. 2 illustrates the flow of air that would inflate the interior 66 of balloon 34 upon the activation of blower of 52. Arrows 70 illustrate the exterior air flowing through air vents 51 and into the interior 22 of base 12, being pulled in by the rotation of blade 56 of blower 52. The air would then travel in the direction of arrows 72 upward into the interior 66 of the balloon 34 and thus moving it into the complete inflated state as seen in FIG. 1.

Figure 6:
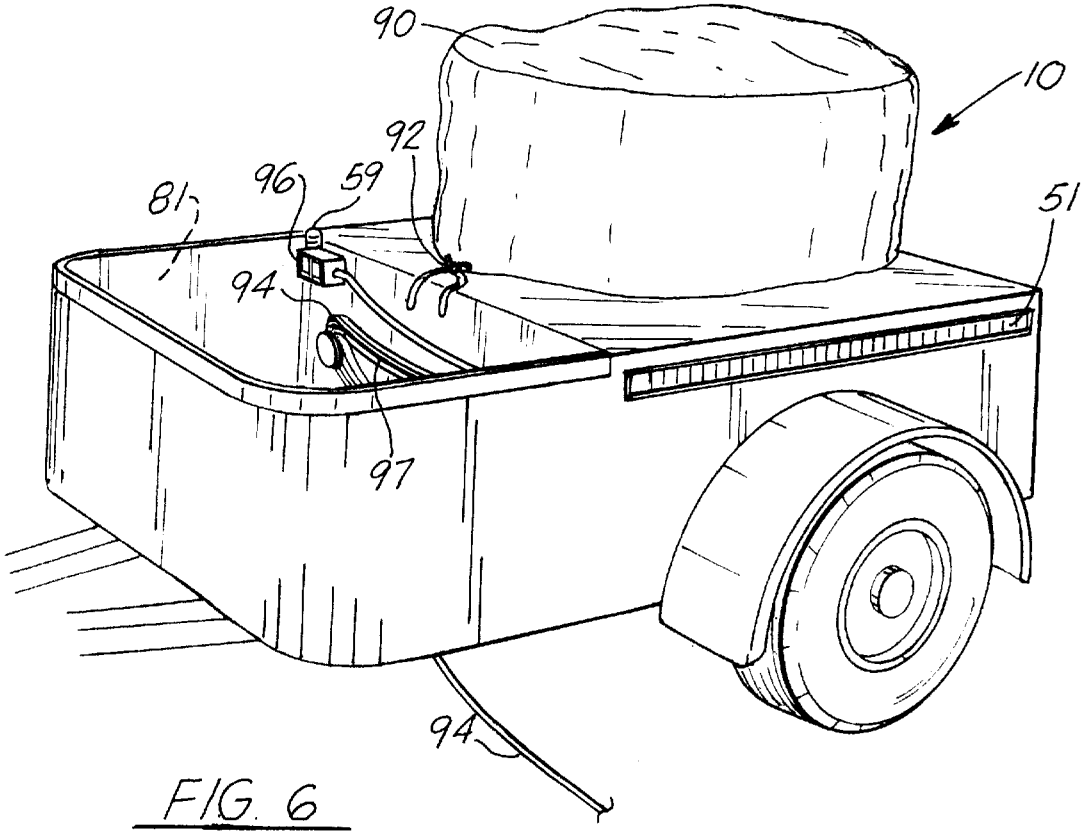
FIG. 6 illustrates an overall view of the system of the present invention as it is in the storage mode, for transport.

Light member 59 would be mounted on top portion 20 of base 12, within circular base member 50 from which the balloon extends. It would include an illumination portion or light 62 so that again, when electrical power is supplied via a light switch to light system 58, the system would project light via a low bay 250 watt metal halide lighting system equivalent to 1,000 watt incandescent for providing necessary lighting for lighting the entire interior of the balloon so that the lighting would be emitted through the balloon fabric to the outside, and any sign placed thereupon would be easily read against the lighted wall of the balloon, directing light rays 64 into the interior 66 of balloon 34 as illustrated both in FIGS. 2 and 3. As illustrated in FIG. 6, light system 58 may include a photo cell 59 which would be mounted adjacent plug outlets 96, so as to cut power to the light member 62 at dawn, and to enable lighting member 62 to glow at dusk during the night time hours. The low bay fixture would direct light rays 64 into the interior 66 of balloon 34 as illustrated both in FIGS. 2 and 3.

Figure 3:
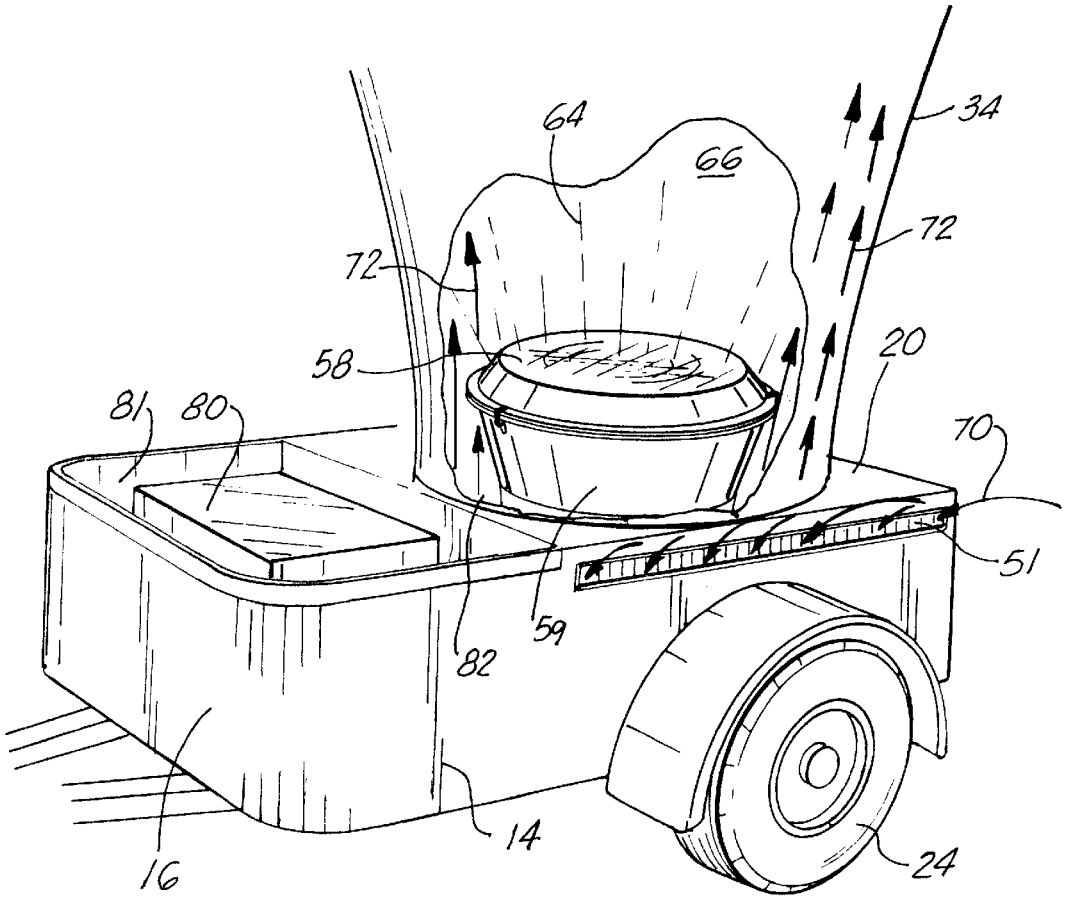
FIG. 3 illustrates a partial cut away view of the inflated balloon with the light and air being blown into the balloon for inflation.

At that time' reference is now made to FIG. 3, where following the air 72 into the interior 66 of balloon 34, the light 58 is illuminated sending light rays 64 upward into the interior 66 of balloon 34 thus illuminating it as shown by the light rays 38 in FIG. 1. As further illustrated in FIG. 3, the balloon is totally inflated and light is being illuminated into the interior of the balloon. There is also illustrated again air 70 being pulled into the air vents 51 via the blower to maintain the balloon 34 in the inflated state. Further, as illustrated in FIG. 3, there is seen a container which represents a self-contained generator system, contained in preferably a 2×4 foot storage area 81, which would be the type of generator that would operate in order to supply continuous electrical power both for the lighting system 58, and the blower 52 while the system 10 is in transport.

Therefore, as one would surmise, for example, if the balloon 34 were being used within a parade or the like, one could power up the generator 80, in order to supply the necessary power to maintain the balloon inflated and illuminated, so that the system 10 could be transported in the parade without having to receive power from an exterior source.

Figure 5:
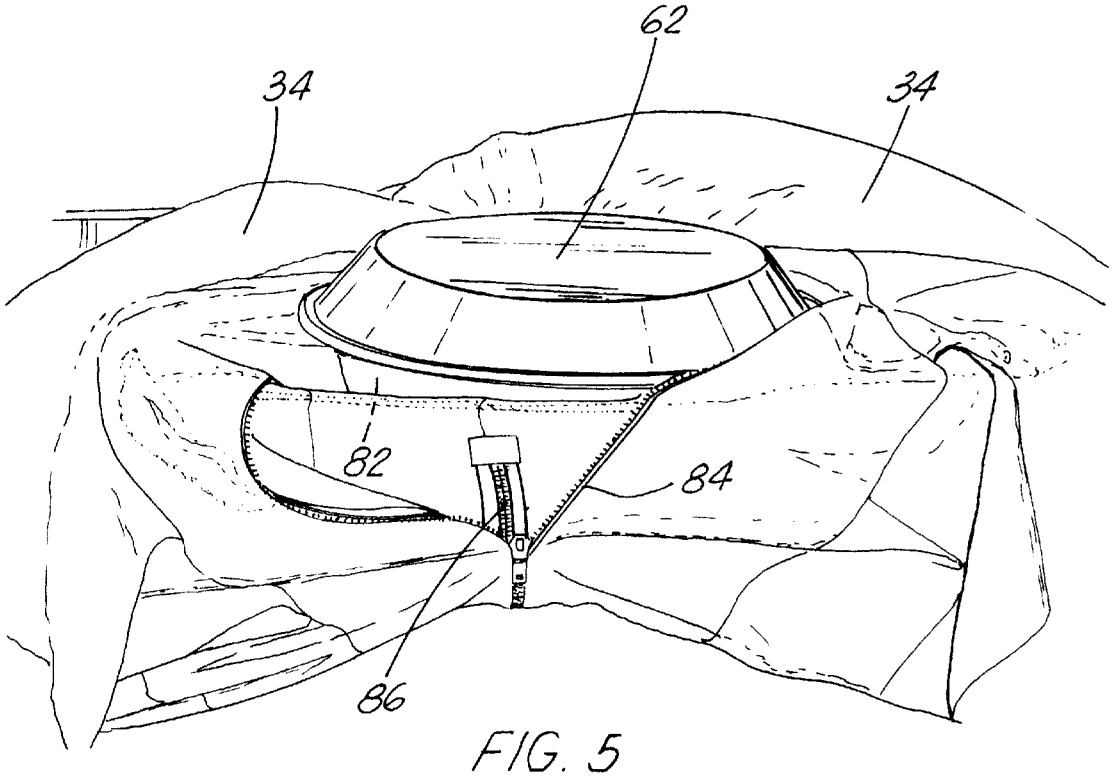

Another important feature of the present system is the fact that the system can be moved from the inflated state, as seen in FIGS. 1–3, to a format for the transport of the system when it is in the deflated state and easily transportable. For example, in FIG. 5, the blower 52 has been deactivated, and therefore the balloon 34 reverts from the inflated state slowly into the deflated state, as illustrated in FIG. 5. Continuing with FIGS. 5, 9, 10, and 11 the lower, constricted portion 48 of balloon 34 is mounted to a circular base member 50 having a height 119, an upper perimeter 120, inner 110 and outer 111 radial walls, and a diameter 118 which secures lower constricted end 48 of the balloon thereonto to give it a supporting base from which it expands and inflates upward. The inner diameter 101 of the constricted portion of the balloon may is secured to the circular base member by hook and loop fastener F, F', so that the constricted portion tightly envelopes the outer surface 122 of the circular base member so that the circular base member, while supporting the balloon in its inflated state, is within the balloon, and not viewable from the outside. Ideally, the height of the circular support member should correspond somewhat with the height of the lower constricted area of the balloon, and should correspond with at least 50% of the height of the lower constricted area of the balloon so as to provide adequate additional support of the balloon.

In use, a casual viewer will not know that the balloon is being supported at its constricted base portion from the inside, the balloon in its inflated state appearing to be standing on its own. It is this feature which provides an important distinguishing characteristic, that is, the ability to provide an stabilizer for the balloon from within to assist the constricted portion of the balloon in withstanding high winds and/or mobile use conditions when the system is being transported in the inflated state.

Figure 7A:
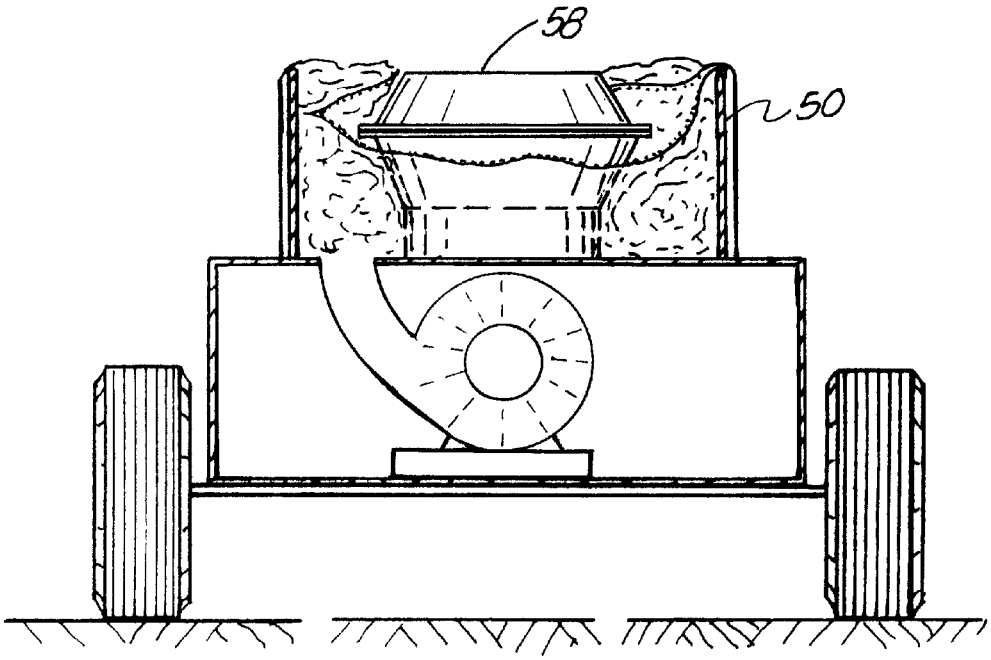
FIGS. 7A–7B is a rear, partially cut-away, partially cross-sectional view of the trailer comprising the base portion, illustrating the operation of the stabilization legs, as well as providing a view of the blower configuration, and the balloon or other inflatable medium stored within the circular base member.
Figure 7B:
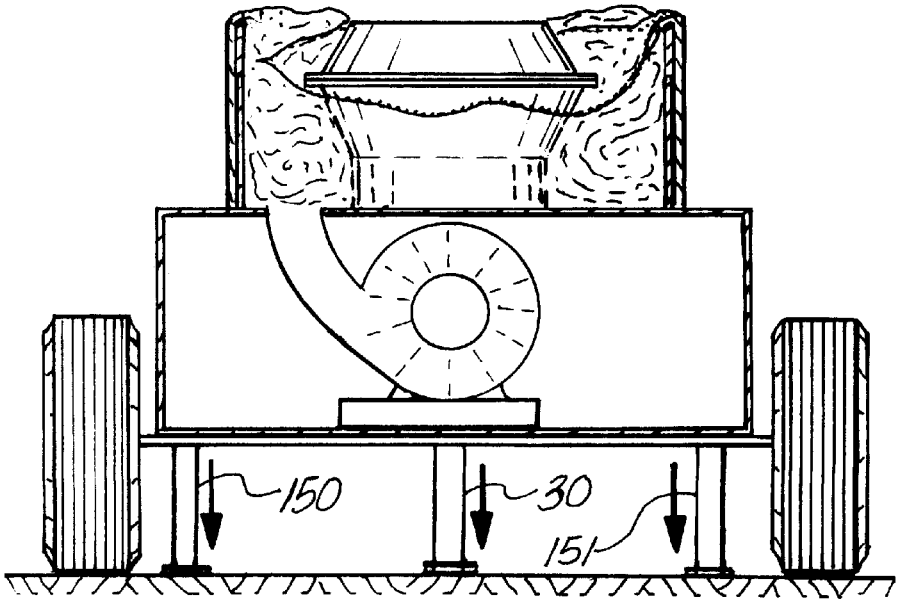
Figure 8:
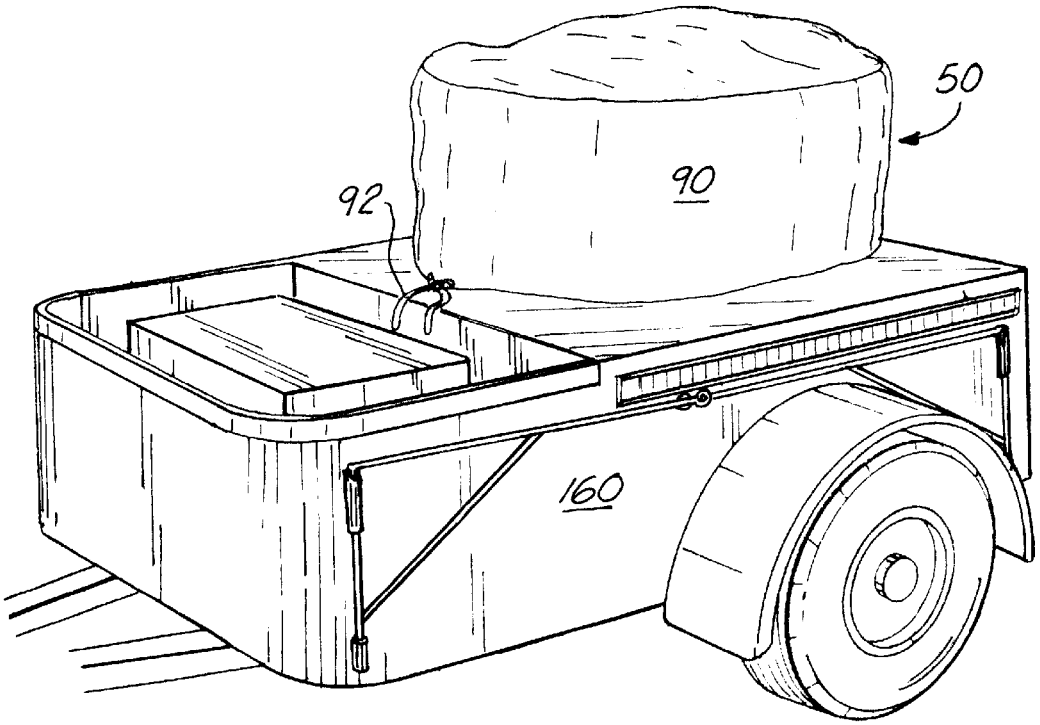
FIG. 8 is an isometric view of the trailer of the present invention with the balloon or other inflatable medium stored within the circular base member, and a covering cap placed about the exterior of the circular base member.
Figure 9:
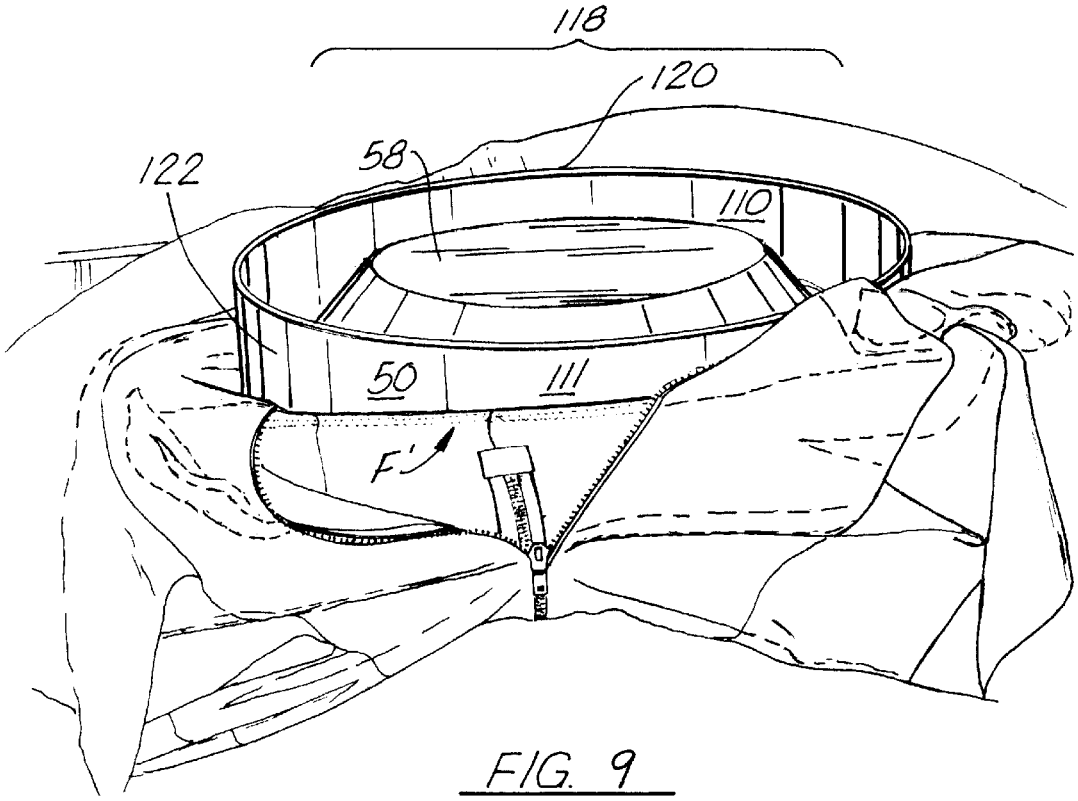
FIG. 9 is an isometric view of the balloon in a deflated state, with its side zipper retracted as in FIG. 5, but with the balloon pulled down further to reveal the circular support member.

As illustrated, the light system 58 is housed within the circular base portion 50 is positioned so that the lighted portion of the light 62 is directed upward into the balloon. Further, there is provided a storage area within the circular base member 50 as seen in FIGS. 4, 7A, and 7B. This open area is designed to accommodate the placement of the deflated balloon within the diameter of the circular base member, so as to envelope the deflated balloon and light therein, and allow the placement of a cover 90 thereupon, as shown in FIGS. 6 and 8.

Figure 4A:
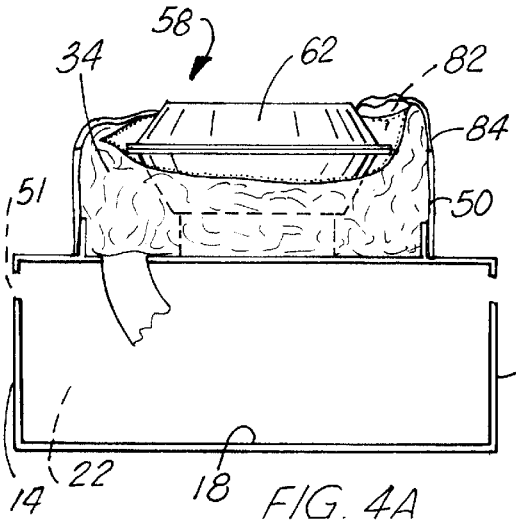
FIGS. 4A, 4B and 5 illustrate partial, cut-away views of the balloon as it has been deflated and is being placed into the storage mode.
Figure 4B:
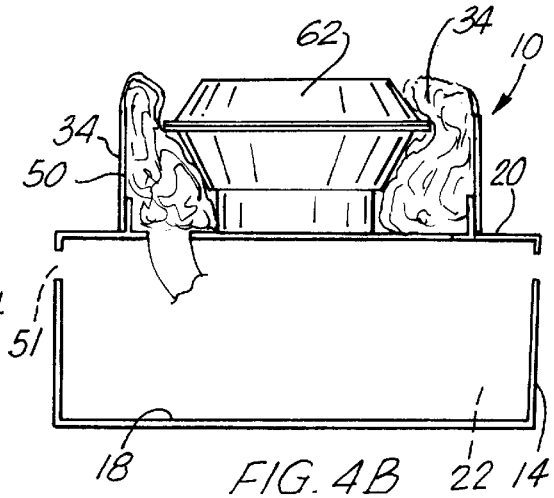

The balloon further includes a zippered portion 84 which includes a continuous zipper 86 so that when unzipped, it defines an opening through which the light 62 can pass therethrough, so that the balloon may be slid about the light as seen more clearly in FIG. 4A, and may be stored within the space 82 between the circular base member 50 and the light member 59 as illustrated in FIG. 4B. As seen in FIGS. 6 and 8, there is provided a cap 90 which would slide about the circular base member 50 and would be tightened thereon via strap 92. After this is completed, FIGS. 6 and 8 represent the system 10 in the storage configuration ready for transport while in that configuration.

Continuing with the drawings, there is provided an electrical cord 94, which would normally be a rugged fifty foot, 14/3 PVC jacketed power cord with a roll-up configuration 97, the cord 94 housed in the storage area 81 which would normally contain the generator system 80. The electrical cord 94 would plug into a plug 96 on the base 12, so as to provide continuous electrical power to the system when the system is stationary. As seen in FIG. 6, the electric cord 96 would extend from a port in the floor portion of the opening of the storage area 81 and would extend out from the bottom of the storage area 81 so as to not have to extend over the side wail 14 of the system.

For example, if the system were to be used in the parking lot of a store for a grand opening or for other stationary uses, rather than use the power of the generator 80, one would simply run an electrical cord 94, plug it into the system 10 via plug 96 and the second end into an electrical outlet for supplying the necessary electrical power.

Now, as was stated earlier, FIG. 3 represents the configuration where the generator 80 is supplying power because the system is being transported, for example, in a parade or the like. Further, there would be included all of the necessary features which are required under the law for allowing the base 12 to be transported via the utility trailer coupling including safety chains, lighting hookup, approved brake turn, running and marker lights or the like. It is foreseen also that there could be other additions to the system to increase its attractiveness such as flags 99 as seen in phantom view extending out of the wall of the apparatus, with the balloon, of course, being shaded in various colors along each of the vertical panels 41 of the balloon as seen in FIG. 1.

Continuing with FIG. 7B, the rear 150 end of trailer may having emanating therefrom stabilizing legs 150, 151 configured to engage the ground G to stabilize the system, in conjunction with the tongue jack 30, when the trailer is disconnected from a vehicle and in stationary use. It is noted that the nature of the design of the present system is that the legs are necessary only in very windy conditions, as the circular base and tether design provide sufficient support for general stationary use and use while moving.

Figure 10:
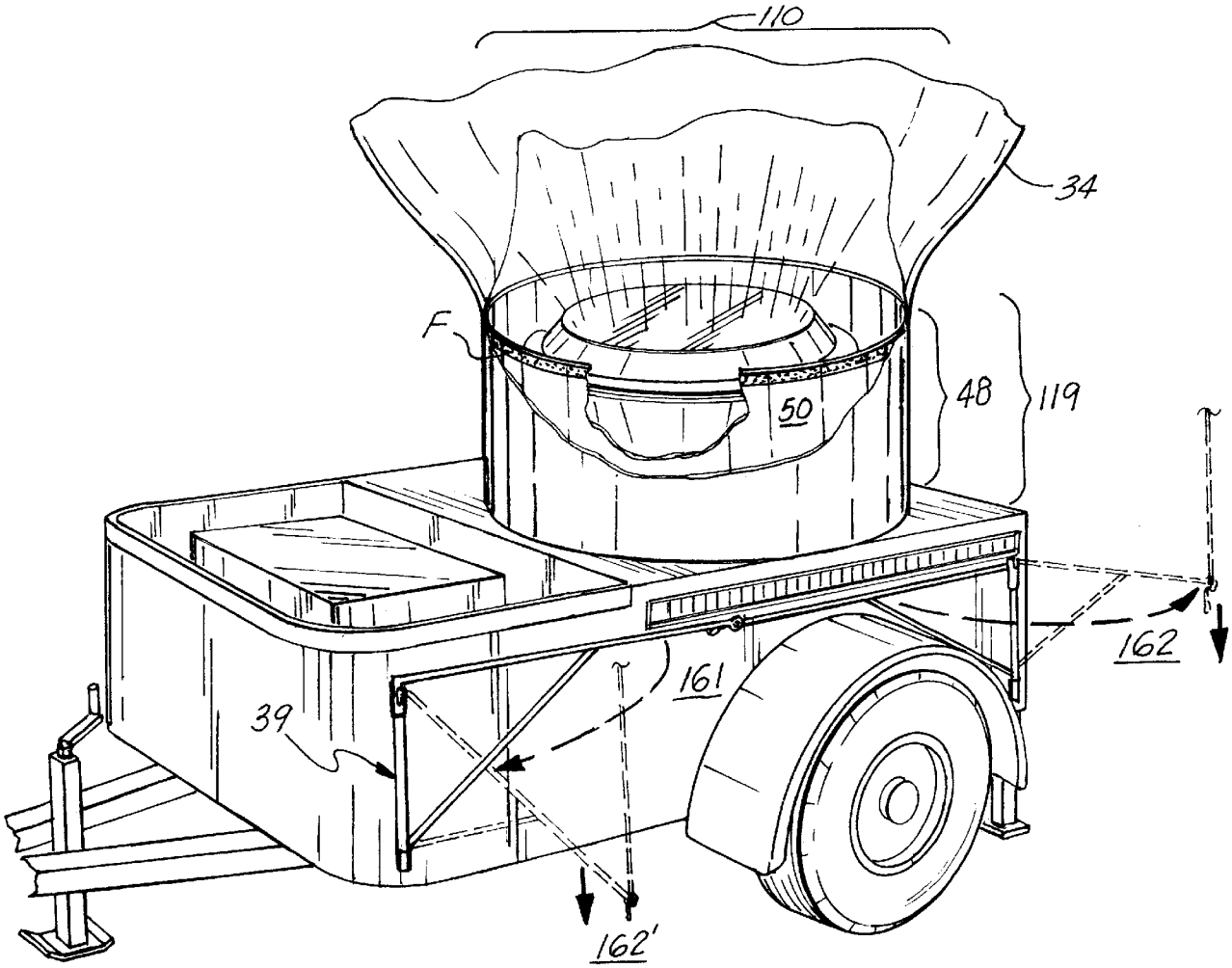
FIG. 10 is an isometric, partially cut-away view of the trailer of the present invention, illustrating the balloon in its inflated state, further illustrating the circular support member engaging most of the constricted or narrow base of the balloon from within the balloon, so as to support same, the view further illustrating the tethers situated in their storage position against the trailer, and in phantom, the tethers situated in their deployed position.
Figure 10A:
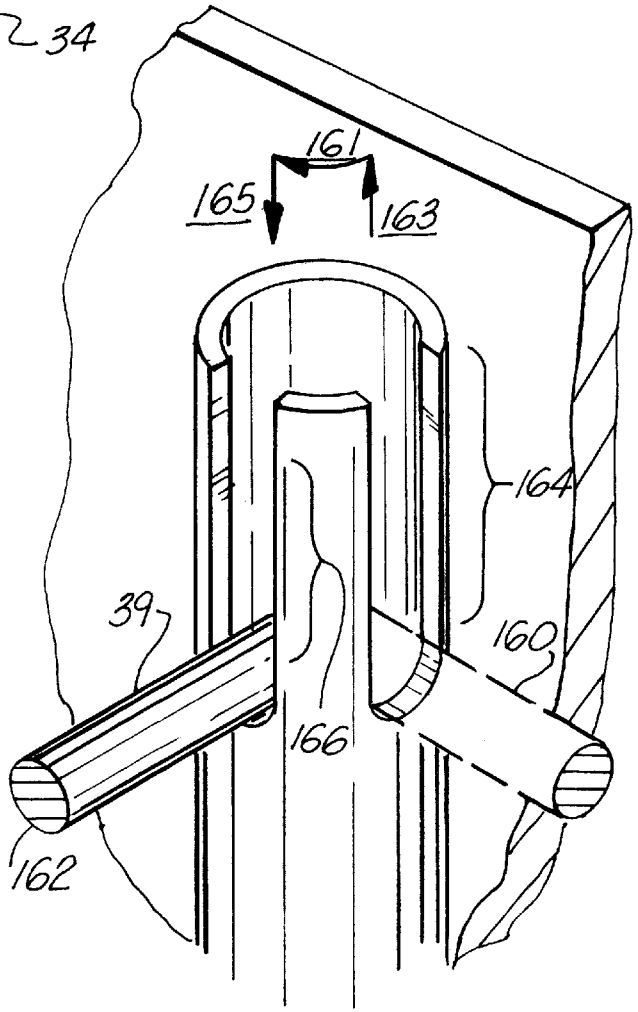
FIG. 10A is an isometric view of an exemplary tether base, illustrating the pivotal action with locking capability at the deployed and storage positions.
Figure 11:
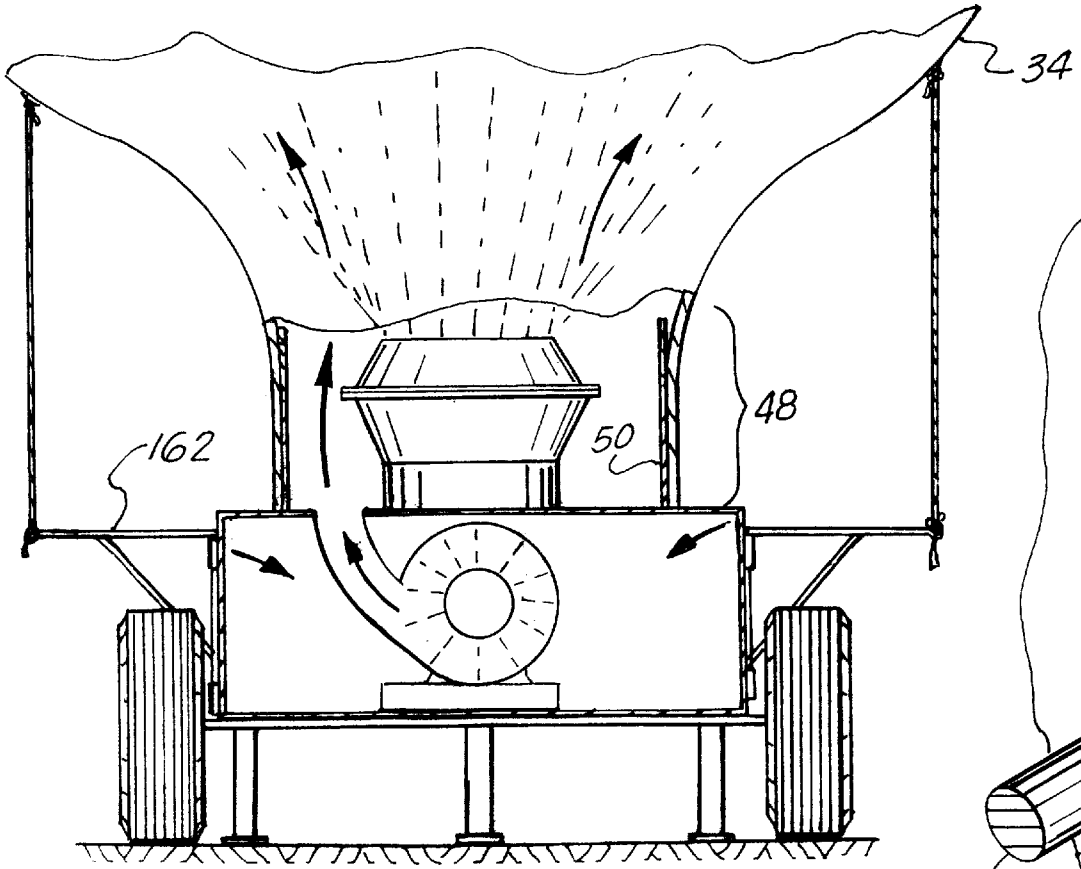
FIG. 11 is an end, partially cut-away view of the trailer of the present invention, illustrating the blower in an activated state, forcing air into the balloon, with the circular base member supported a majority of the constricted or narrow area of the base of the balloon, and the tethers engaging via line the larger perimeter of the body of the balloon.

Continuing with FIGS. 8, 10, and 11, the support arms 39 or outriggers may be mounted to the base or trailer in a pivotal fashion, so as to be stored in a storage position 160 adjacent to the trailer, and pivot 161 to extend 162, 162' to the tether position, to engage support line 37. An example of a pivotal locking mechanism for the support arms may be found in FIG. 10A. In use, the support arm would be lifted out of slot 164, pivoted 161, and deposited 165 into outer slot 166, placing the arm in the extended 162 position. Retracting the arm into the storage position would simply entail the reverse.

In summary, an example of the method of use of the present invention may include the following steps:

a) providing a trailer, comprising:

a. a base portion mounted upon a frame having wheels thereupon;

b. a circular support member inner and outer walls, a height and a diameter, said circular support member engaged to and emanating from said base portion;

c. an inflatable balloon having an outer and inner surface, a constricted lower portion and upper portion, said inner surface of said constricted lower portion lower portion mounted to said outer wall of said circular support member so as to engage said height and width of said support member, so as support said constricted lower portion of said balloon;

d. a blower for blowing air into the balloon, so as to inflate the balloon;

e. message display means for displaying a message on said outer surface of said balloon;

b) hitching said trailer to a vehicle;

c) engaging said blower to blow air into the balloon;

d) allowing said balloon to inflate, such that said balloon walls become taut from the air pressure within the balloon, lifting the balloon into an inflated position;

e) supporting said constricted lower portion of said balloon with said circular support member within said balloon, along the height and width of said circular support member;

f) pulling said trailer with said vehicle while said balloon is inflated, so as to display said balloon in a moving fashion.

Further, there may be provided the additional steps of providing a light source, and energizing said light source so as to illuminate said balloon from within, as well as providing the additional steps of providing support arms emanating from said base, and supporting said upper portion of said balloon via support lines running from said support arms to said upper portion of said balloon.

Other steps and alternatives may be added or detracted, depending upon the intended use and circumstances.

PARTS LIST

The following is a list of suitable parts and materials for the various elements of the preferred embodiment of the present invention.

system 10
base portion 12
side walls 14
end walls 16
floor portion 18
top portion 20
interior space 22
wheels 24
utility trailer mount 26
coupling 28
tongue jack 30
arrow 32
balloon 34
equator 35
wall portion 36
support lines 37
lines 38
arms 39
message display portion 40
message 41
loop and ring attachment (Velcro") 42
lower constricted end 48
circular base member 50
air entry vents 51
blower 52
flow port 53
blade portion 56
light system 58
photo cell 59
illumination portion 62
light rays 64
interior 66
arrow 72
air 70
generator 80
opening 81
space 82
zipper portion 84
zipper 86
cap 90
strap 92
electrical cord 94
plug 96

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

I claim:

1. An apparatus for displaying a message, comprising:

a support member having a height and a width, and inner and outer walls;

an inflatable balloon having an outer surface, a lower portion and upper portion, said lower portion of said balloon mounted to said support member, engaging said support member so as to support said lower portion of said balloon;

a blower for blowing air into the balloon, so as to inflate said balloon said support member further having formed therein a storage area within said inner wall of said support member, said storage area formed so as to permit the storage of said balloon within said storage area.

2. The apparatus of claim 1, wherein said support member engages and emanates from a base.

3. The apparatus of claim 2, wherein said support member has a diameter and is circular, forming a circular support member, said circular support member having radial inner and outer walls, and wherein said lower portion of said balloon is constricted, providing a constricted lower portion, said constricted lower portion having an inner radial wall which engages said outer radial wall of said support member about said diameter of said support member, such that said height of said support member corresponds to over half of said height of said constricted lower portion of said balloon.

4. The apparatus of claim 3, wherein there is further provided a message display means mounted on said outer surface of said balloon.

5. The apparatus of claim 2, wherein said base portion is mounted on wheels to form a trailer.

6. The apparatus of claim 2, wherein there is further provided air intake vents formed in said base portion so as to provide airflow to said blower.

7. The apparatus of claim 1, wherein said lower portion of said inflatable balloon engages said support member via hook and loop fastener.

8. The apparatus of claim 1, wherein there is further provided a cover configured to enclose said storage area situated in said support member, so as to shield a balloon situated therein.

9. The apparatus of claim 1, wherein there is further provided a light mounted within said inner wall of said circular support member.

10. The apparatus of claim 9, wherein there is further provided means on the balloon for defining an opening in the balloon wall such that, when the balloon is deflated, said balloon may be stored about said light.

11. The apparatus of claim 10, wherein there is further provided a photo cell for energizing said light in dark conditions, and de-energizing said light during lighted conditions.

12. The apparatus of claim 9, wherein there is further provided a cap configured to envelope said outer wall of said circular support member, covering said circular support member and shielding any contents located therein.

13. The method of deploying a balloon, comprising the steps of:

a) providing:

a support member having a height and a width, and inner and outer walls said support member having formed therein a storage area;

an inflatable balloon having an outer surface, a lower portion and an upper portion, said lower portion mounted to said support member so as to support said lower portion of said balloon, said balloon configured to be able to be stored in said storage area formed in said support member when said balloon is in a deflated condition;

a blower for blowing air into the balloon, so as to inflate said balloon;

b) engaging said blower to blow air into said balloon;

c) inflating said balloon, such that said balloon walls become taut from the air pressure within said balloon, expanding said balloon into an inflated position, so as to provide an inflated balloon;

d) allowing said support member to support said inflated balloon;

e) disengaging said blower;

f) deflating said balloon, providing a deflated balloon; and g) storing said deflated balloon in said storage area formed in said support member.

14. The method of claim 13, wherein there is provided the additional steps of providing a light source, and energizing said light source so as to illuminate said balloon from within.

15. The method of claim 14, wherein there is further provided the additional steps of providing support arms emanating from said base, and supporting said upper portion of said balloon via support lines running from said support arms to said upper portion of said balloon.

16. The method of conveying a message, comprising the steps of:

a) providing a. a support member having inner and outer walls, said support member having formed therein a storage area;

b. an inflatable balloon having an outer surface, a lower portion and upper portion, said lower portion mounted to said support member;

c. indicia on said outer surface of said balloon;

b) inflating said balloon, so as to provide an inflated balloon;

c) supporting said lower portion of said inflated balloon with said support member;

d) positioning said balloon such that said indicia on said outer surface of said inflated balloon may be discerned by an observer;

e) deflating said balloon, so as to provide a deflated balloon; and f) storing said balloon in said storage area formed in said member.

17. The method of claim 16, wherein there is provided the additional steps of providing a light source, and energizing said light source so as to illuminate said balloon from within.

18. The method of claim 17, wherein there is further provided the additional steps of providing support arms emanating from said base, and supporting said upper portion of said balloon via support lines running from said support arms to said upper portion of said balloon.

* * * * *